US006003507A

United States Patent [19]

Flick et al.

[11] Patent Number: 6,003,507

[45] Date of Patent: Dec. 21, 1999

[54] GAS HEATER HAVING FIREBOX WITH CONTROLLABLE OUTSIDE AIR MIXING VENT

[75] Inventors: Christopher L. Flick, Fort Wayne; Corbit Beasey, Roanoke, both of Ind.

[73] Assignee: American Hearth Systems, Inc., Fort Wayne, Ind.

[21] Appl. No.: 09/221,080

[22] Filed: Dec. 28, 1998

[51] Int. Cl.[6] ..... F24B 1/189

[52] U.S. Cl. ..... 126/515; 126/512; 126/529; 126/530; 126/85 B

[58] Field of Search ..... 126/512, 515, 126/528, 529, 530, 85 B

[56] References Cited

U.S. PATENT DOCUMENTS

| | | | |
|---|---|---|---|
| 3,056,397 | 10/1962 | Little . | |
| 4,108,144 | 8/1978 | Wilhoite . | |
| 4,141,336 | 2/1979 | Fitch . | |
| 4,185,612 | 1/1980 | Briner et al. . | |
| 4,519,376 | 5/1985 | Schoeff et al. . | |
| 4,553,528 | 11/1985 | Wells . | |
| 4,793,322 | 12/1988 | Shimek et al. . | |
| 4,909,227 | 3/1990 | Rieger . | |
| 4,928,667 | 5/1990 | Shaw . | |
| 5,320,086 | 6/1994 | Beal et al. | 126/512 |
| 5,542,407 | 8/1996 | Hawkinson | 126/512 |
| 5,816,237 | 10/1998 | Fleming | 126/512 |
| 5,906,197 | 5/1999 | French et al. | 126/512 |

OTHER PUBLICATIONS

Standard for Factory–Built Fireplaces UL–127 7th Edition, May 16, 1996, 9 pages.

Installation manual for the Majestic; MBU36, MBU36i, MBU42, MBUC36, MBUC36i, MBUC42, MBU42i, MBUC42i Factory Built Fireplace; Majco Building Specialties, L.P. 1993, 19 pages.

Installation manual for the Majestic; Models: MR42A/MRC42A Factory Built Fireplaces; For Use In U.S./Canada; Majco Buildings Specialties, L.P. 1994, 20 pages.

Installation and operation instructions for the Majco Building Specialties Vented Type Decorative Gas Appliance; Models: GAS36TV, GAS36TV–LP; Majco Building Specialties, L.P. 1991, 15 pages.

Installation and operation instructions for the Majco Building Specialties Vented Type Decorative Gas Appliance; Models: G450pi, G450adi, G450piLP, G450adiLP, G490pi, G490adi, G490piLP, G490adiLP; Majco Building Specialties, L.P. 1992, 14 pages.

Installation and operation instructions for the Majco Building Specialties Vented Type Decorative Gas Appliance; Models: G800pi, G800adi, G800piLP, G800adiLP; Majco Building Specialties, L.P. 1992, 24 pages.

Installation and operation instructions for the Majco Building Specialties Vented Type Decorative Gas Appliance; Models: G2000pi, G2000adi, G2000piLP, G2000adiLP; Majco Building Specialties, L.P. 1991, 24 pages.

Installation and operation instructions for the Majestic (Direct Vent) Gas Appliances; Models: G36DVpi, G36DVpiLP, G36DVadi, G36DVadiLP; Majco Building Specialties, L.P. 1992, 19 pages.

(List continued on next page.)

*Primary Examiner*—Carroll Dority
*Attorney, Agent, or Firm*—Howell & Haferkamp, LC

[57] ABSTRACT

A fireplace has a firebox with a controllable outside air vent to provide a source of cooler air for mixing with and modulating the temperature of the air heated by the fireplace. The air vent is vertically formed between a combustion chamber and a surrounding shell so that a convective current causes the air to flow therethrough and pass over the top surface of the combustion chamber to keep it cooler than otherwise possible with heated room air. Convective currents in another air duct formed between the shell and the combustion chamber circulates room air around the combustion chamber to transfer heat to the room air. The warmed outside air and room air mixes in a plenum above the fireplace prior to entering the room, thereby modulating the temperature of the heated air and permitting it to burn without excessively heating the room. A damper regulates the flow of outside air into the air vent, as desired.

20 Claims, 5 Drawing Sheets

OTHER PUBLICATIONS

Installation and operation instructions for the Majco Building Specialties Vented Type Decorative Gas Appliance; Models: GBU36, GBU36LP, AGA: Natural Gas and Propane, CGA: Natural Gas Only; Majco Building Specialties, L.P. 1991, 16 pages.

Installation and operating instructions for Majestic Vent–Free Fireplaces; Models: VF30/BK (non–circulating with black hood), VF30/PB (non–circulating with polished brass hood) for use with Majestic VL18 or VL18 LP vent–free gas log heaters, VFC30/BK (circulating with black hood), VFC30/PB (circulating with polished brass hood); Majestic 1995, 12 pages.

Installation and operating instructions for Majestic Vent–Free Fireplaces; Models: VF36/BK (non–circulating with black hood), VF36/PB (non–circulating with polished brass hood), VFC36/BK (circulating with black hood), VFC36/PB (circulating with polished brass hood) for use with Majestic VL21 or VL21 LP vent–free gas long heaters; Majestic 1995, 20 pages.

Installation and operating instructions for Majestic Vent–Free See–Thru and Cove Fireplaces; Models: VF36ST, VF36CV for use with Majestic VL24M or VL24M LP vent–free gas log heaters; Majestic 1995, 20 pages.

Installation and operating instructions for Majestic Vent–Free Fireplaces; Models: VF42/BK (non–circulating with black hood), VF42/PB (non–circulating with polished brass hood), VFC42/BK (circulating with black hood), VFC42/PB (circulating with polished brass hood) for use with Majestic VL24 or VL24 LP vent–free gas log heaters; Majco Building Specialties, L.P. 1994, 11 pages.

Installation and operation instructions for the Majco Building Specialties Outside Air Kit: Model: AK–MST; Majco Building Specialties, L.P. 1992, 2 pages.

Installation and operation instructions for the Majco Building Specialties, L.P Outside Air Kit; Model: G800–AK; Majco Building Specialties, L.P. 1989, 2 pages.

Installation and operations instructions for the Majco Building Specialties, L.P. Outside Air Kit; Model: G1000–AK; “Not for Use in Canada”, 2 pages.

Installation and operation instructions for the Majco Building Specialties Outside Air Kit; Model: GAK; “Not for Use in Canada”, 2 pages.

GAS HEATER HAVING FIREBOX WITH CONTROLLABLE OUTSIDE AIR MIXING VENT

BACKGROUND OF THE INVENTION

This invention relates generally to gas heaters comprising fireplaces having fireboxes, and more specifically to fireboxes for direct vent and vent-free gas fireplaces. The invention may also be used without gas burners and instead with conventional wood burning fireplaces such as fireplace inserts which are typically added after a home is built.

The many advantages of fireplaces have been known for centuries. Today, fireplaces are desired and used chiefly for decorative purposes or as supplemental heating sources for homes. Not only can they provide a reliable, cost effective source of heat, but they are always considered to add a soothing, entertaining, and attractive atmosphere to a home.

It is no surprise then that fireplaces are becoming increasingly popular. Recent developments in gas fired fireplaces have resulted in versatile fireplace units that in some cases are freestanding and that in other cases may be installed relatively easily and inexpensively as compared to their woodburning counterparts that quite often require extensive construction and design considerations to install, especially after the home is first built. Modern fireplaces, however, are not without application difficulties that may interfere with their use and enjoyment. For instance, in many cases fires may only be tolerated for shortened time periods because of the intense heat that they can produce. This problem is especially evident when entertaining groups of people in a room with a fireplace. The temperature in the room quickly becomes unacceptably warm, leaving the host of the gathering with the choice of turning off the fireplace or opening windows. Neither of these options is desirable. Opening windows will create chilly drafts and noticeably warm and cool spots in the room, while shutting down the fireplace will detract from the ambiance of the room. Too often, the aesthetics of the fireplace are sacrificed because the room becomes too hot, too soon. Indeed, many gas-fired fireplaces are equipped with sensors that will shut the fire down when either the temperature of the fireplace or of the room reaches a predetermined set point, all to the dismay of the fireplace owner when the fireplace shuts down in a matter of minutes once a gathering begins.

Although as expected the firebox itself becomes very hot as a fire burns within it, the top area of the combustion chamber becomes especially hot as the heat naturally rises and concentrates at the horizontal beam spanning the top front of the firebox opening. This concentrated heat, if not properly insulated, literally bakes the surrounding building materials, such as wood studs and the finish materials as well. This not only shortens the life and sacrifices the appearance of the finish, but also is an ineffective use of the heat. Furthermore, as these surrounding building materials heat up, they themselves become a source of radiant heat which further intensifies the heat emanating into the room from the fireplace.

Finally, the warmth from a fireplace and the use of room air for combustion increases the negative pressure of a home in relation to the outside atmosphere. Thus, when an outside door is opened, it can cause a rush of cold heavy air into the home. The blast of cold air is always unwelcome and a warm fire only intensifies this experience. To alleviate these undesirable effects, quite often a homeowner will crack open a window while a fire is burning in a fireplace. Unfortunately, this often creates a chilly draft which is also undesirable.

One solution offered by several prior art devices is to provide outside air to the fireplace, not just for combustion purposes, but to more efficiently harness the heat of the fireplace by circulating cold outside air around the firebox to simultaneously heat the outside air and cool the firebox, thereby more efficiently using the heat generated by a fire while concurrently introducing cooler air into the room and alleviating the intense heat emanating from the fireplace. One such example is found in U.S. Pat. No. 4,928,667 which incorporates a blower to force outside air through a heat exchanger having a serpentine path and then into the room. While this arrangement does serve to capture heat which might otherwise escape through the flue, it requires a blower to force the outside air through the heat exchanger and yet does not reduce the heat concentrated at top of the firebox opening. Furthermore, the addition of a blower increases the initial cost and complexity of the fire place, and also the energy cost and maintenance over its useful life.

Fireplaces having fireboxes of prior art design are therefore disadvantaged in that they either suffer from intense heat generation which can force them to be shut down or otherwise inefficiently mix in outside air at increased cost and without eliminating the concentration of heat at its most intense point of build up, they can inefficiently transfer heat to building materials surrounding this point of concentrated intense heat, and they can increase the negative pressure in the home relative to the outside atmosphere.

SUMMARY OF THE INVENTION

Among the several advantages of the instant invention may be noted the provision of a fireplace having a firebox that can control the heat generated from the fireplace and thus allow for a longer enjoyable use of the fireplace; the provision of a fireplace with a firebox that efficiently mixes heated air from the firebox with outside air before the mixed air enters the room; the provision of a fireplace having a firebox wherein the outside air is efficiently ducted through the firebox using convective forces to minimize the requirement of a blower; the provision of a fireplace having a firebox wherein the mixed air is routed over the center front horizontal cross beam of the firebox at the point of greatest heat concentration, thereby reducing the deleterious effect of excess heat build up on surrounding building materials; the provision of a fireplace having a firebox that alleviates negative pressure buildup in a home; and the provision of a simple, cost effective fireplace having a firebox that achieves the aforesaid advantages without requiring costly blowers and the like to achieve effective operation.

Generally, the present invention comprises a fireplace having a combustion chamber surrounded by a shell to form contiguous first and second air ducts. The first air duct passes outside air into the room after mixing it with heated air from the room that passes through the second air duct. The outside inlet to the first air duct is controlled to thereby control the amount of outside air introduced into the room. With this arrangement, the firebox is cooled as the air in the two ducts is heated, outside air is warmed and mixed before introduction into the room, and cooler air passes over the center top opening of the firebox which is the point of most intense heat build up. Thus, the present invention of a fireplace having a firebox of the present design may be adjusted to introduce either more or less outside air as circumstances warrant to control the heat introduced into the room and allow for the fireplace to be enjoyed for extended time periods without overheating the room.

Because the first air duct receives cold outside air at an elevation relatively lower than where it exhausts into the room, natural convection currents draw air into the air duct where it is heated as it rises through the first air duct. As the outside air flow is the result of natural convention currents, a blower is not needed to circulate it through the first air duct and into the room. Optionally, more ducts may be incorporated to increase the capacity for outside air to cool the firebox.

A damper connected to the first air duct regulates the flow of outside air into the first air duct. Thus, a fireplace owner may vary the amount of outside air introduced to the system depending on the circumstances, and also depending on the particular control used and provided for the damper. Manual control could be provided or, optionally, the damper could be electronically controlled and opened, closed, or adjusted according to an operator selected settings. Letting in outside air relieves negative pressure in the home, and the damper could be operated independently of the fireplace to regulate the flow of outside air through the duct to balance the pressure in the home relative to the outside atmosphere if desired.

The firebox of the present design could be used in all types of fireplaces, but is especially suited for vent-free and direct vent gas fired fireplaces. The versatility of those units would be limited only by access to outside air, which in most cases will be readily available.

Optionally, one or more additional air ducts could be incorporated into the present invention to separately provide outside air as an aid to combustion in the combustion chamber. It is noteworthy, however, that the present invention provides a separate duct for the outside air that mixes with the heated room air, although the same duct could "tee" off to separately supply combustion air.

While the principal advantages and features of the invention have been explained above, a fuller understanding of the invention may be gained by referring to the drawings and description of the preferred embodiment which follows.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

While the invention shown in the figures and described herein is in the context of a vent-free or direct vent fireplace, it is recognized that the advantages of the invention accrue to all types of fireplaces. The description of the preferred embodiment in this application is not intended to restrict the practice of the invention to vent free and direct vent fireplaces. The advantages of the invention may be enjoyed in a large variety of constructions that one of ordinary skill in the would readily appreciate. Therefore, the embodiments shown and described herein are for illustrative purposes only.

Figure 1:
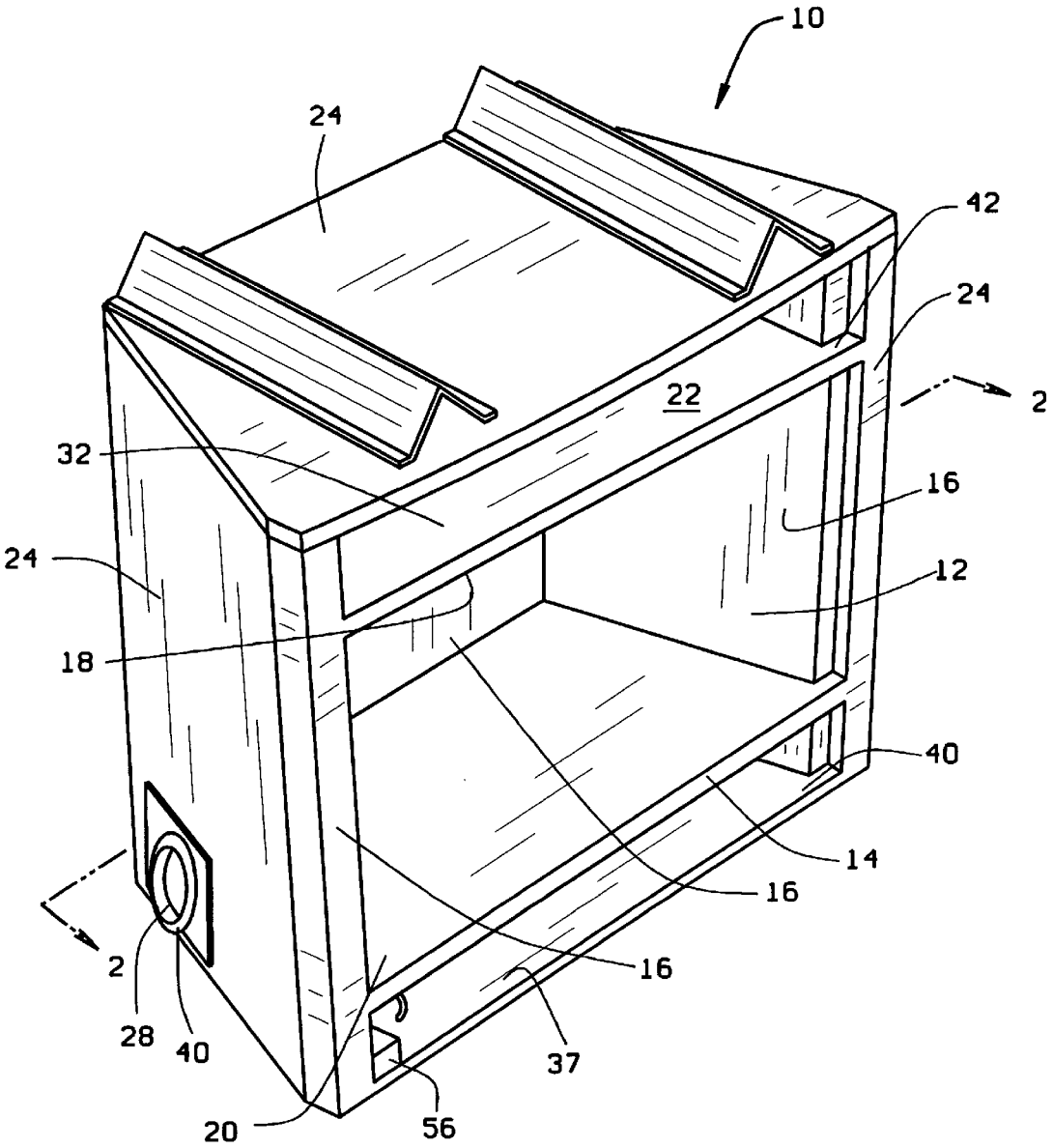
FIG. 1 is a perspective view of a fireplace according to the present invention.

Referring now to the Figures, a first embodiment of the invention for use in a vent free fireplace is indicated generally by the reference numeral 10 in FIG. 1. The invention comprises a combustion chamber 12 suitably sized and shaped to accommodate a gas log, burner, or other combustion device including wood burning logs and accessories. The combustion chamber 12 has a floor 14, at Least one side wail 16, a top 18, and an open side 20 which faces the room interior so that the inside of the combustion chamber 12 is visible from inside the room. A glass door assembly or other suitable covering such as a mesh screen may be provided to close the open side 20 of the combustion chamber 12.

The combustion chamber 12 may be made of any suitable material known in the art that can withstand the intense heat generated therein. Also, the dimensions of the combustion chamber 12 may vary considerably as desired to vary the heating capacity of the fireplace, accommodate a larger gas log or burner, improve the aesthetics of the firebox, etc. Preferably, the side walls 16 of the combustion chamber 12 will be generally perpendicular to the combustion chamber floor 14 and top 18, but it is appreciated that curved walls and other shapes of the combustion chamber 12 may be incorporated to change the appearance of the firebox without compromising the advantages of the invention. In any event, however, the combustion chamber 12 has an exterior surface 22 that is heated considerably as a fire burns within.

Surrounding the exterior 22 of the combustion chamber 12 is a shell 24 The shell may be made of any suitable material known in the art that is capable of safely supporting the combustion chamber and is heat resistant. Preferably, the shell is lightweight to reduce the bulk of the firebox, although this is not necessary to appreciate the advantages of the invention. The shell may be decorated with real or simulated stone, brick, wood or other finish as desired to enhance the appearance of the shell, should the fireplace be free standing. Also, mantels and/or other fireplace accessories may be incorporated to finish the appearance of the fireplace.

Figure 2:
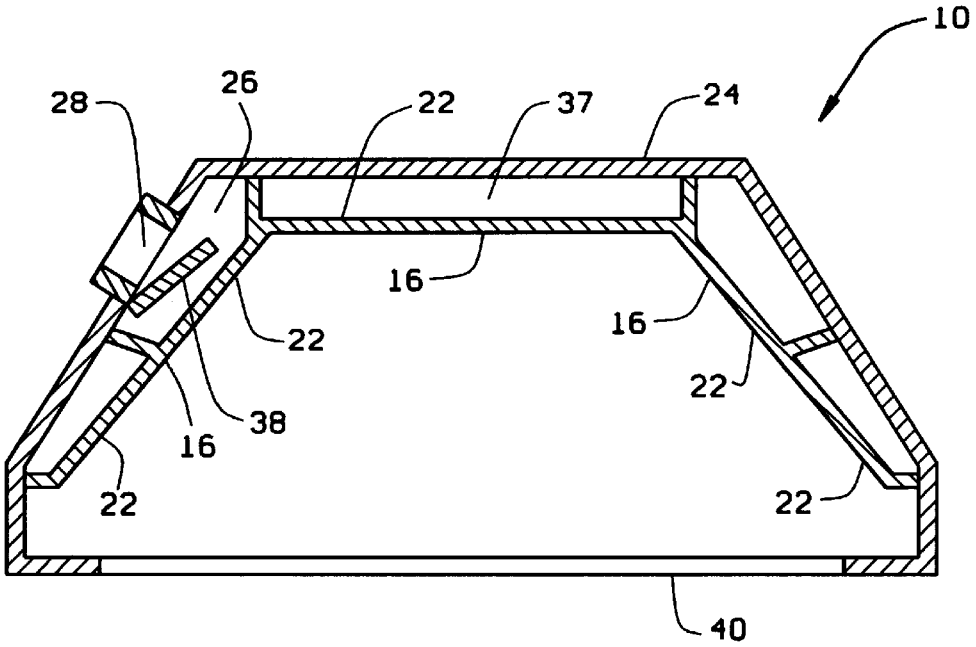
FIG. 2 is a cross-sectional view taken along the line 2—2 in FIG. 1 and depicting the damper and ducting.
Figure 3:
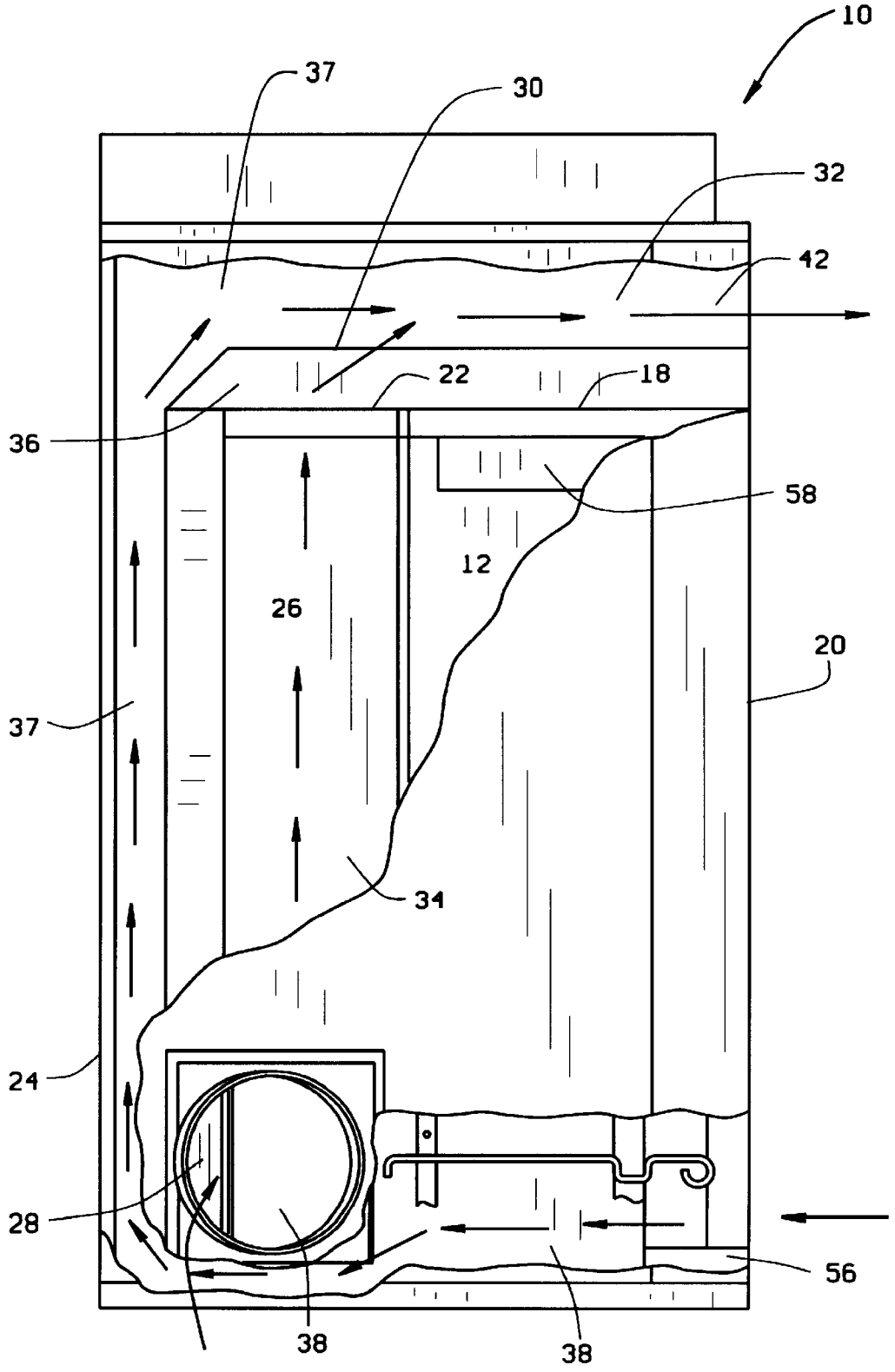
FIG. 3 is a side view of the fireplace of the present invention partially broken away to reveal the interior of the firebox.

Referring now to FIGS. 2 and 3, a first air duct or passage 26 is formed between the shell 24 and the exterior surface 22 of the combustion chamber 12. The first air duct 26 has a first end 28 in communication with outside air. A second end 30 of the first air duct or passage 26 communicates with room air through the plenum chamber 32 as described below. The first end 28 of the first air duct 26 is preferably capped with a screen to prevent entry of foreign objects or creatures into the passage.

The first air duct or passage 26 opens into a plenum chamber 32 at its second end 30. The plenum chamber is an expanded duct or passage formed between the shell 24 and the interior 22 of the combustion chamber 12 that allows outside air to pass over the exterior surface 22 of the top 18 of the combustion chamber. The heat from the top 18 of the combustion chamber warms the relatively cool outside air passing into the plenum chamber 32 through the first duct 26. Consequently, the exterior surface 22 of the top 18 of the combustion chamber 12 is cooled. Preferably, the first duct or passage 26 is contiguous to at least one exterior surface 22 of a side 16 of the combustion chamber 12 and contiguous to the exterior surface 22 of the top 18 of the combustion chamber to maximize heat transfer from the exterior surface to the air in the duct.

The first duct or air passage 26 preferably has a first portion 34 that is generally vertically oriented and a second portion 36 that is generally horizontally oriented. Also, the passage 26 preferably communicates with outside air at an elevation below the floor 14 of the combustion chamber 12 to maximize convection currents as air inside the first passage 26 is heated as it travels through the first end 28 and out the second end 30 of the duct. It is recognized, however, that other configurations of the duct may achieve some or all of the advantages of the invention, as well as other elevations above and below the plenum chamber where the first end 28 of the first duct 26 communicates with outside air. Also, the dimensions of the first duct 26 may be varied to increase or decrease the capacity for handling outside air. Also, more than one air duct may be used to bring more outside air into the system.

A second air duct or passage 37 is formed between the shell 24 and other portions of the exterior surface 22 of combustion chamber 12 for circulation and heating of room air. Room air circulates by way of convection through an inlet vent 40 underneath the floor 14 of the combustion chamber 12 and into the plenum chamber 32 located at the top of the combustion chamber. As room air circulates through second air duct 38, it is warmed by the heat generated by the combustion in combustion chamber 12, as is well known in the art. Once the room air enters the plenum chamber 32, it mixes with the outside air delivered by the first air duct 26. The mixture of warmed room air and warmed outside air then enters the room through the outlet vent 42 of the plenum chamber 32. As the first 26 and second 37 ducts are contiguous, heat exchange also takes place between the first and second air ducts. Thus, the cooler outside air in the first duct 26 is warmed by the warmer room air circulating in the second duct 37.

Figure 4:
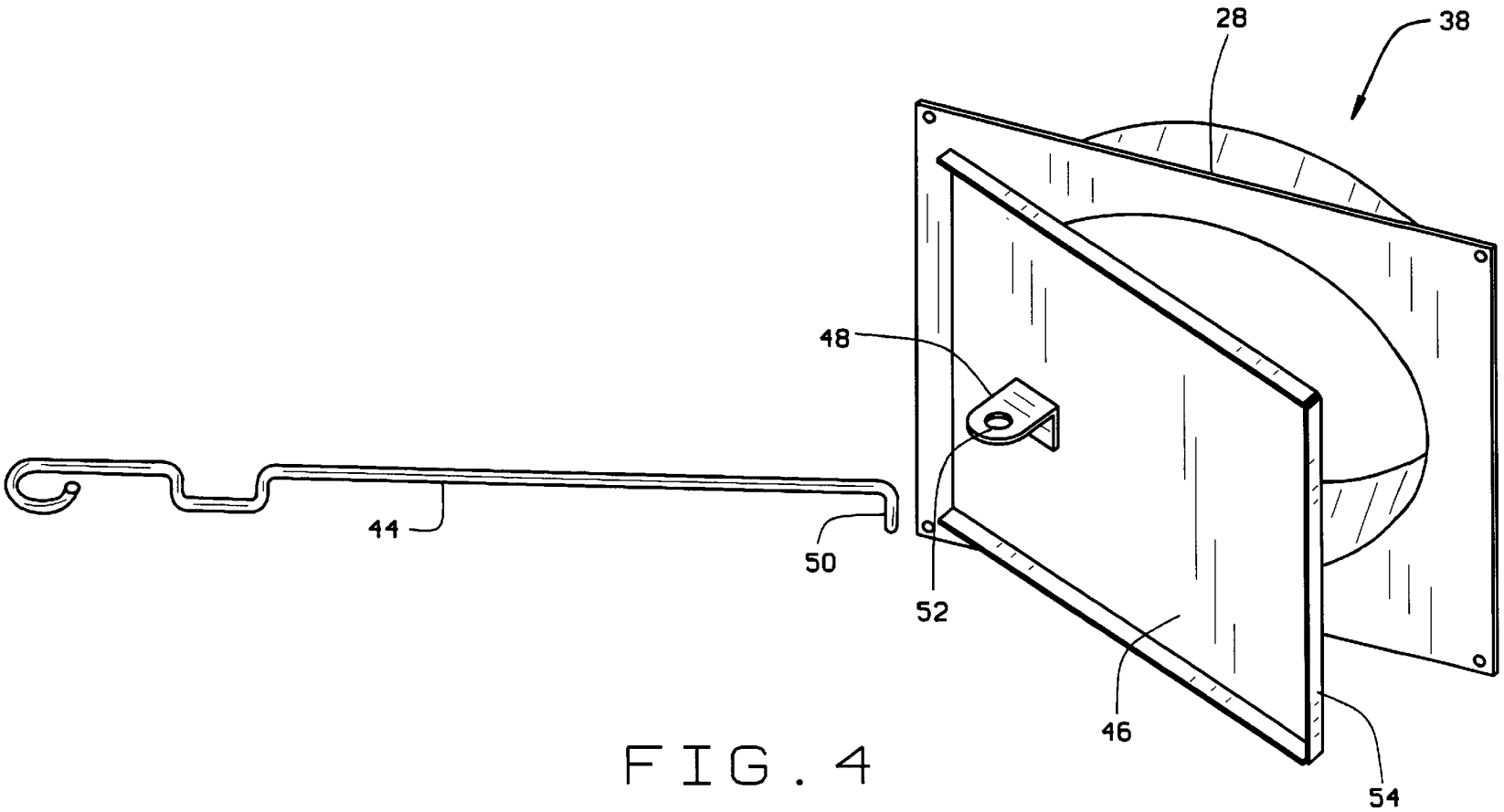
FIG. 4 is a perspective view of a damper assembly according to the present invention.

A damper assembly 38 is positioned at the first end 28 or inlet of the first air duct 26 to regulate the flow of outside air thereinto. As is best seen in FIG. 4, the damper assembly includes a rod 44 that connects to a flat damper door 46 via a bracket 48. A downward bend 50 of the rod inserts into a hole 52 in the bracket for manually opening and closing of the damper. A gasket 54 seals the damper door to the inlet 28 to prevent outside air from entering the system as desired, such as in the summer months. Preferably, the damper assembly 38 is adjustable to several positions to vary the amount of outside air that enters the first duct 26.

Optionally, the damper assembly 38 may be controlled automatically. For instance, electronic controls and a motor (not shown) may be used in conjunction with a control 56 (FIG. 3) to open, close, or adjust the damper, and hence the flow of outside air into the system, at predetermined control settings. For instance, a thermostat, pressure sensor, or other device may be used in conjunction with electronic controls to operate the damper in response to environmental conditions. The controls may be part of the fireplace unit, or may be remote from the unit as desired by a user. Furthermore, the damper assembly 38 may also be used, manually or automatically, to balance the pressure between the inside and outside of a home even when the fireplace is not being used. Thus, the home may be allowed to breathe through the first duct 26 by opening, closing, or adjusting the damper assembly 38 as desired and as dictated by the relative environmental conditions inside and outside of the home.

For a vent-free fireplace, a catalytic converter 58 as shown in FIG. 3 is mounted within the combustion chamber 12 to filter combustion by-products out of the air in the combustion chamber before the air enters the room.

Briefly, the invention operates as follows. When a fire is lit in the combustion chamber 12, the exterior casing 22 of the combustion chamber 12 is heated by the fire. As the exterior casing 22 is heated, so is the air in the first 26 and second 38 ducts and the plenum chamber 32 between the shell 24 and the exterior casing or surface 22 of the combustion chamber. As the exterior surface 22 of the combustion chamber 12 becomes hot and heats the air in the air ducts 26, 38, it rises and a convection current draws air into the first 26 and second 38 air ducts.

Assuming that the damper assembly 38 is opened, outside air enters the vertical portion 34 of the first duct 26 and is heated as it rises through the duct, as generally indicated by the arrows in FIG. 3. The outside air then flows into the horizontal portion 36 of the first duct 26 where it is directed horizontally over the exterior surface 22 of the top 18 of the combustion chamber 12.

Meanwhile, the hot exterior casing 22 of the combustion chamber creates a convection current that draws room air into the second duct 38 underneath the floor 14 of the combustion chamber 12. The room air rises through the second air duct 38 and is heated by the exterior surface 22 of the back side wall 16 of the combustion chamber 12, and ultimately enters the plenum chamber 32 and is directed horizontally over the exterior surface 22 of the top 18 of the combustion chamber 12. Inside the plenum chamber 32, the warmed room air from the second duct 38 mixes with the relatively cooler outside air from the first duct before entering the room through the outlet 42 of the plenum chamber. Because the first and second ducts are contiguous, heat transfer takes place between the warm room air and the cooler outside air.

As the first 26 and second 38 ducts communicate with incoming outside air and room air, respectively, at a point below the floor 14 of the combustion chamber 12, natural convective currents draw the mix of outside and room air in the plenum chamber 32 over the exterior surface 22 of the top 18 of the combustion chamber 12 where the air is heated some more before it enters the room. Due to the natural convection currents, no blower or other external means is required to circulate air through the system.

Thus, because the heat delivered by the fireplace can be adjusted, the present invention can provide a longer lasting, more enjoyable fire experience than do the fireplaces of the prior art. Additionally, as the cooler outside air is directed over the top of the firebox, heat from the firebox is less likely to damage surrounding building materials, mantels, and other finishing touches on a fireplace, so repair and maintenance intervals to these items will be prolonged.

Finally, the air flowing through the passage 26 relieves the negative pressure in the home relative to the outside atmosphere. This benefit could be enjoyed year round as the damper 38 may be opened or closed independent of the operation of the fireplace itself.

Figure 6:
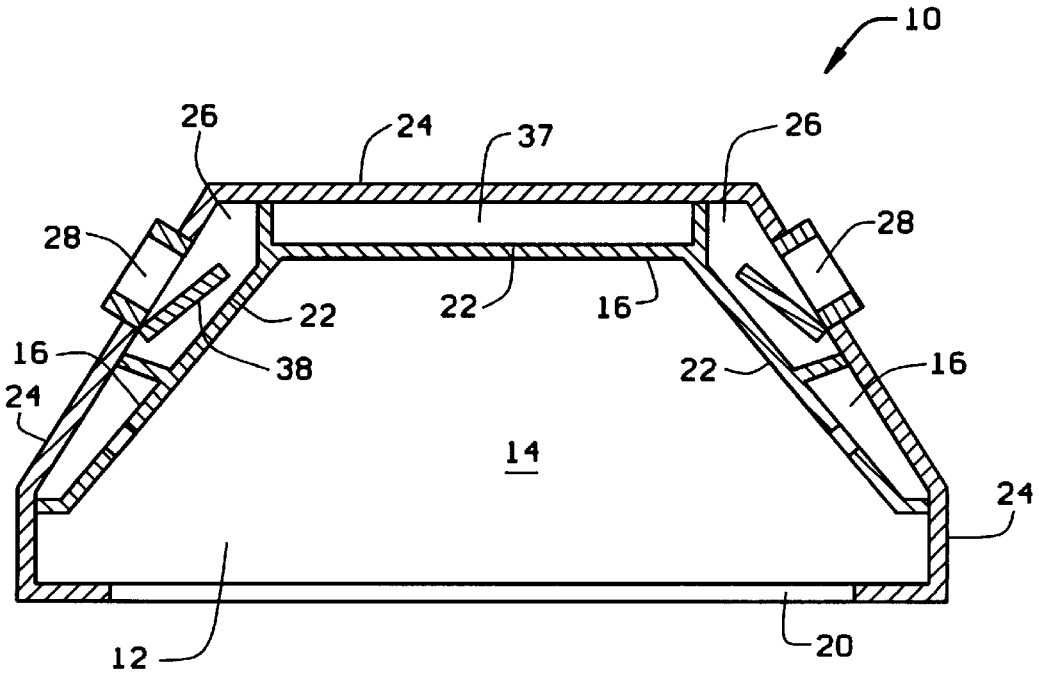
FIG. 6 is a cross-sectional view taken along the line 6—6 of FIG. 5 and depicting the damper and ducting.
Figure 5:
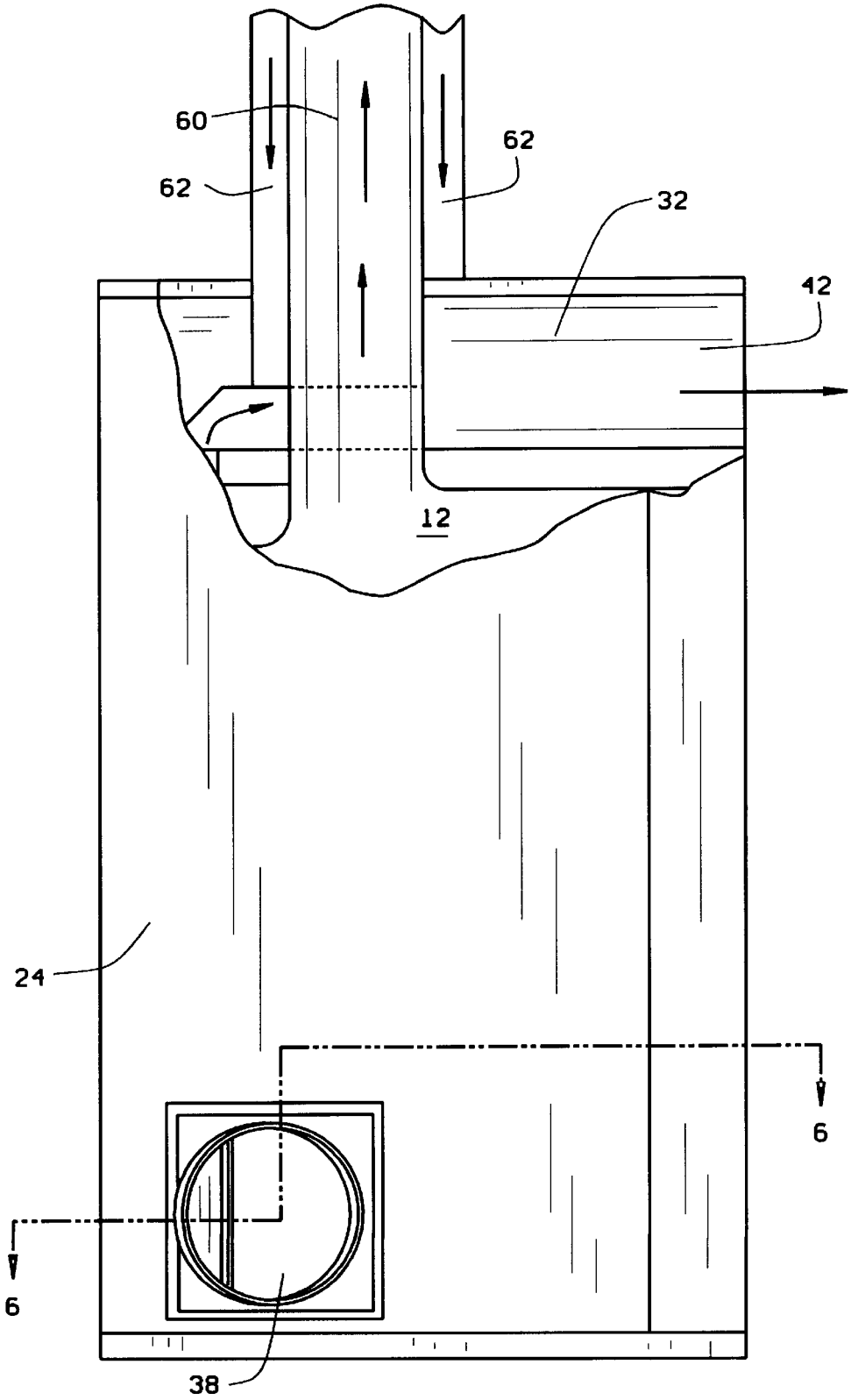
FIG. 5 is a side view of another embodiment of the invention partially broken away to reveal the interior duct work.

Referring now to FIGS. 5 and 6, another embodiment 10' of the invention is depicted in the form of a direct vent fireplace. The invention operates the same as described above in relation to FIGS. 1 through 4, albeit with the noticeable modification of a flue 60 or exhaust vent of any suitable type known in the art to exhaust combustion by-products from the room where the firebox is located. Additionally, one or more combustion vents 62 may introduce outside air to the combustion chamber 12 to aid combustion. It is noted, however, that the combustion vent (s) 62 do not communicate with the outside air in the first duct or passage 26. In other words, the air drawn through the first duct or passage 26 is not used for combustion, while the air in the second duct or vent 44 is used for combustion. It is recognized, however, that a "tee" could be used to create separate cooling and combustion ducts from a single source of outside air.

Also, as is noted above, more than one first air duct 26 may be used to introduce more outside air into the system, such as the two first air ducts 26 shown in FIG. 6. Optionally, one or more second air ducts 38 could be used to circulate room air around the firebox in a direct vent fireplace as well. The air ducts formed between the shell 24 and the exterior casing 22 of the combustion chamber 12 provide ideal support and strength to the shell as well as achieving the many advantages of the invention.

While the present invention has been described by reference to specific embodiments, it should be understood that modifications and variations of the invention could be constructed without departing from the scope of the invention which is limited only by the language of the following claims and their legal equivalents.

What is claimed is:

1. A fireplace having a firebox, said firebox comprising:

a combustion chamber having an exterior top surface;

a plenum chamber over the exterior top surface of the combustion chamber so that heat therefrom may be dissipated into the plenum chamber, the plenum chamber having an outlet communicating with a heating area; and a first air duct connected to the plenum chamber and in fluid communication with outside air, the first air duct conducting outside air in a generally vertical direction to the plenum chamber in response to natural convection currents when air in the plenum chamber reaches a temperature greater than that of the outside air, thereby drawing cool outside air into the plenum chamber where it is heated by the top surface of the combustion chamber and directed into the heating area.

2. The fireplace of claim 1, wherein the first air duct receives outside air at an elevation below the plenum chamber.

3. The fireplace of claim 1, further comprising a damper connected to the first air duct to regulate outside air flow into the first air duct.

4. The fireplace of claim 1, further comprising a control to open the damper at a predetermined setting, thereby relieving negative pressure at the outlet of the plenum chamber.

5. The fireplace of claim 1, further comprising a catalytic converter in the combustion chamber to filter the heated air in the combustion chamber before it enters the heating area.

6. The fireplace of claim 1, further comprising a combustion vent in fluid communication with outside air and the combustion chamber, the combustion vent delivering air into the combustion chamber to aid combustion.

7. The fireplace of claim 6, wherein the first duct and combustion vent do not communicate with one another.

8. The fireplace of claim 6, further comprising an exhaust vent in fluid communication with the combustion chamber and outside air, thereby directing combustion by-products away from the combustion chamber to outside air.

9. A fireplace having a firebox for installation in a room of a house or the like, said firebox comprising:

a combustion chamber having an exterior casing and an open side;

a shell surrounding the casing except for the open side;

at least one air passage directing air between the shell and the casing and over the top of the casing so that heat from the casing may be dissipated into the passage, the passage being in fluid communication with outside air on a first end and room air on a second end, thereby allowing a convective flow of cool outside air through the air passage when a fire burns in the combustion chamber, thereby cooling the casing and the shell.

10. The fireplace of claim 9, wherein the at least one air passage directs air between the shell from below to over the top of the casing.

11. The fireplace of claim 9, further comprising a damper to regulate a draft of air through the air passage.

12. The fireplace of claim 11, further comprising a control to operate the damper to relieve negative pressure in a heating area.

13. The fireplace of claim 9, further comprising a catalytic converter within the combustion chamber to filter combustion by-products from air in the combustion chamber before the air enters a heating environment.

14. The fireplace of claim 9, further comprising an exhaust vent to discharge combustion by-products from the combustion chamber away from the heating environment.

15. The fireplace of claim 9 wherein the casing has at least one side wall and a top surface, the air passage having a first portion that is generally vertical and contiguous to the at least one side wall and a second portion that is generally horizontal and contiguous to the top surface, thereby heating air in the passage along the top surface and at least one side of the casing.

16. The fireplace of claim 15 wherein the combustion chamber includes a floor, and the air passage communicates with outside air at an elevation below the floor of the combustion chamber.

17. A fireplace having a firebox for installation in a room of a house or the like, the firebox having a combustion chamber within which a fire may safely burn, a first air vent at least partially surrounding said combustion chamber and ducted to receive outside air, a second air vent at least partially surrounding said combustion chamber and ducted to receive room air near a lower part of said combustion chamber, each of said air vents communicating with a common plenum located adjacent the top front of said combustion chamber so that the cooler outside air is mixed with the hotter room air in the plenum before the air is delivered to the room.

18. The fireplace of claim 17 wherein the first air vent is ducted to receive outside air near a lower part of said combustion chamber.

19. The fireplace of claim 17 further comprising a damper located near an inlet to the first air vent to control the amount of outside air permitted to flow into said first air vent.

20. The fireplace of claim 19 wherein each of said air vents are in direct contact with the combustion chamber, and are thus heated thereby.

* * * * *